US010242773B2

(12) United States Patent
Dittert et al.

(10) Patent No.: US 10,242,773 B2
(45) Date of Patent: Mar. 26, 2019

(54) SEPARATING DEVICE FOR AN OVERVOLTAGE PROTECTION ELEMENT

(71) Applicant: PHOENIX CONTACT GMBH & CO. KG, Blomberg (DE)

(72) Inventors: Maik Dittert, Bad Salzuflen (DE); Jan Hegerfeld, Paderborn (DE); Herr Jan-Erik Schmutz, Detmold (DE)

(73) Assignee: PHOENIX CONTACT GMBH & CO. KG (DE)

( * ) Notice: Subject to any disclaimer, the term of this patent is extended or adjusted under 35 U.S.C. 154(b) by 0 days.

(21) Appl. No.: 15/921,145

(22) Filed: Mar. 14, 2018

(65) Prior Publication Data

US 2018/0268968 A1 Sep. 20, 2018

(30) Foreign Application Priority Data

Mar. 15, 2017 (DE) ..... 10 2017 204 299

(51) Int. Cl.

| | |
|---|---|
| ***H01C 1/02*** | (2006.01) |
| ***H01C 7/12*** | (2006.01) |
| ***H01C 13/02*** | (2006.01) |
| ***H01H 71/02*** | (2006.01) |

(52) U.S. Cl.

CPC ..... *H01C 1/02* (2013.01); *H01C 7/12* (2013.01); *H01C 13/02* (2013.01); *H01H 71/02* (2013.01)

(58) Field of Classification Search

CPC ..... H01C 1/02; H01C 7/12; H01C 13/02
USPC ..... 338/21
See application file for complete search history.

(56) References Cited

U.S. PATENT DOCUMENTS

| | | | | |
|---|---|---|---|---|
| 3,781,749 | A * | 12/1973 | Iles | G01K 7/183 29/612 |
| 4,378,489 | A * | 3/1983 | Chabinsky | H05B 3/10 219/543 |
| 4,498,337 | A * | 2/1985 | Gruner | G01F 1/692 338/25 |
| 6,791,812 | B1 * | 9/2004 | Maatta | H01C 7/12 361/103 |
| 2015/0288176 | A1 * | 10/2015 | Durth | H01C 7/10 361/91.2 |
| 2017/0279269 | A1 * | 9/2017 | Durth | G01R 31/1236 |

* cited by examiner

*Primary Examiner* — Kyung S Lee
(74) *Attorney, Agent, or Firm* — Sheridan Ross P.C.

(57) ABSTRACT

The invention relates to a separating device for an overvoltage protection element, wherein the separating device is to be arranged between the overvoltage protection element and a thermal disconnector, wherein the separating device has a first insulating layer and a second insulating layer, wherein a conductive layer is arranged between the first insulating layer and the second insulating layer, wherein the first insulating layer has a first cutout for a contact with the disconnector, and wherein the second insulating layer has a second cutout for a contact with the overvoltage protection element, wherein the cutouts provide a possibility for contacting the conductive layer and the conductive layer provides a thermal bridge between the overvoltage protection element and the thermal disconnector, with the insulating layers making both a thermal and an electrical insulation available, so that heat of the overvoltage protection element can be conducted in a focused manner to the thermal disconnector.

10 Claims, 6 Drawing Sheets

SEPARATING DEVICE FOR AN OVERVOLTAGE PROTECTION ELEMENT

CROSS-REFERENCE TO RELATED APPLICATIONS

This application claims the benefit of German Patent Application No. DE102017204299.0 filed Mar. 15, 2017, the entire disclosure of which is incorporated herein by reference.

The invention relates to a separating device for an overvoltage protection element.

BACKGROUND OF THE INVENTION

Surge protectors are required in many areas of electrical engineering. The problem arises time and time again that the surge protectors need to be reliable while not being excessively expensive to manufacture.

Typically, surge protectors have an overvoltage protection device and a disconnector. One example of an overvoltage protection device is a varistor.

The thermal disconnector protects the overvoltage protection device and disconnects it from the network in the event of an overload or advanced aging of the overvoltage protection device.

For this purpose, an opening is usually provided in the housing (inner housing) through which the tab of the overvoltage protection device is electrically contacted.

This wall separates the overvoltage protection device into two logical regions. One side contains the overvoltage protection device and the other side the arc interrupt, for example.

Plasma can form when the overvoltage protection device is rapidly overloaded, which produces a high temperature and high pressure. By virtue of the opening in the wall, however, plasma is able to flow from one side of the wall to the other.

This effect is usually promoted by the fact that the wall is damaged/deformed by the thermal effect of plasma/arc.

However, this impairment/damage can also result in the functioning of the disconnecting device being impaired or damaged. For example, guide rails and slide surfaces of the disconnecting means can be deformed.

This can lead to substantial problems, since the overvoltage protection device can now be seriously damaged, which can cause explosions and/or fires.

In order to address these problems, a wide variety of solutions have been proposed in the past; for example, the guide rails and slide surfaces of the disconnecting means have been appropriately reinforced and/or spring forces for disconnection and hence the force on the disconnector substantially over-dimensioned in order to compensate for the effect of the plasma on the disconnection devices (friction, counterforce by the plasma).

The extinguishing capacity of today's disconnecting devices is limited by mechanical loading (destruction of the overvoltage protection device). If cutoff occurs at excessively high currents, the damage can result in a non-functional disconnecting device.

OBJECT OF THE INVENTION

In view of this situation, it is an object of the invention to make an improved separating device available that makes it possible to provide a structurally small and economical disconnecting means.

BRIEF DESCRIPTION OF THE INVENTION

The object is achieved by a device according to claim 1. Additional advantageous embodiments particularly constitute the subject matter of the dependent claims.

BRIEF DESCRIPTION OF THE DRAWINGS

The invention is explained in further detail below with reference to the figures.

DETAILED DESCRIPTION

The invention is explained in further detail below with reference to the figures. It should be noted that different aspects are described, each of which can be utilized individually or in combination.

That is, any aspect can be used with different embodiments of the invention, provided that it is not portrayed explicitly as a mere alternative.

Moreover, for the sake of simplicity, reference will generally be made in the following to only one entity. Insofar as not noted explicitly, however, the invention can also have several of the entities concerned. Therefore, the use of the words "a," "an," "of a" and "of an" is to be understood only as an indication to the effect that at least one entity is used in a single embodiment without the use of a plurality of entities.

Figure 4:
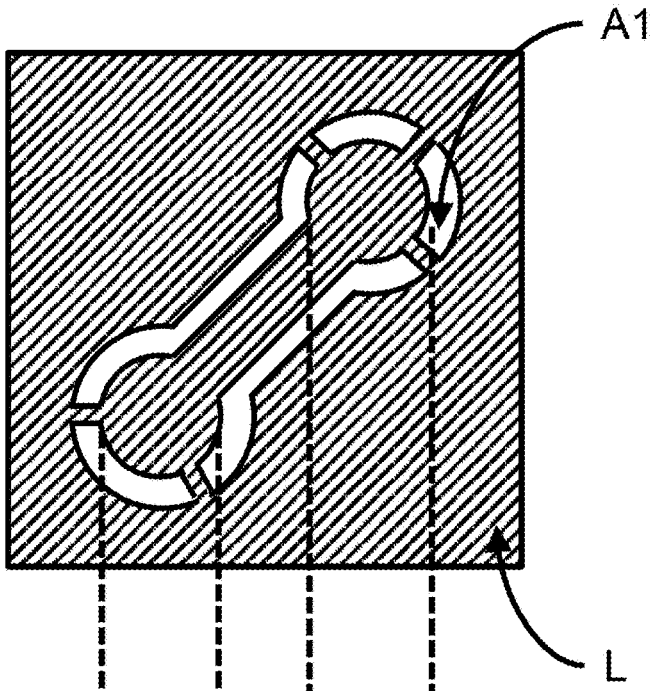
FIG. 4 shows a top view of a conductive layer according to an additional embodiment of the invention.
Figure 5:
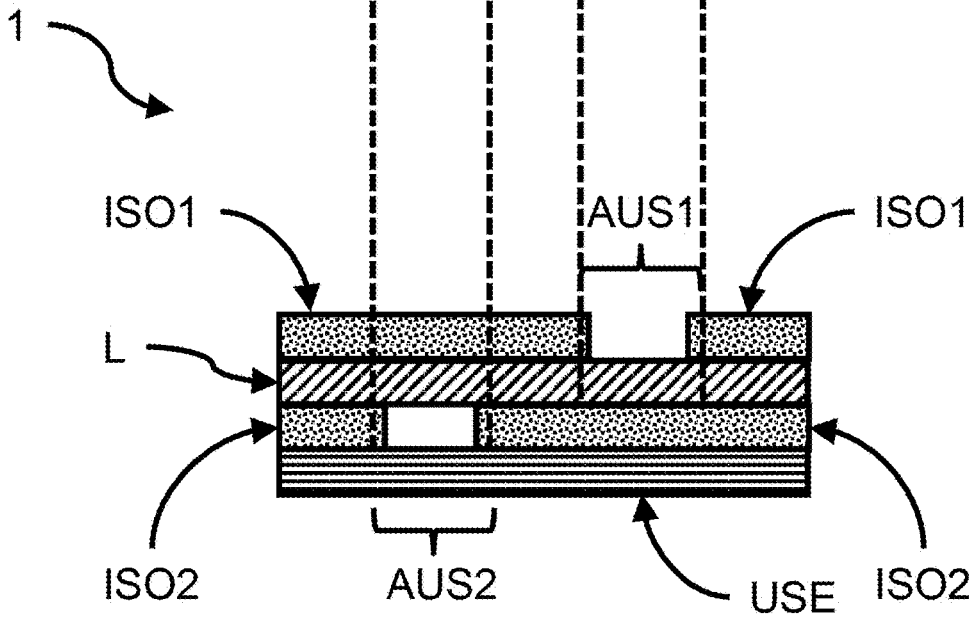
FIG. 5 shows a schematic sectional view of a separating device with a conductive layer according to FIG. 4.
Figure 6:
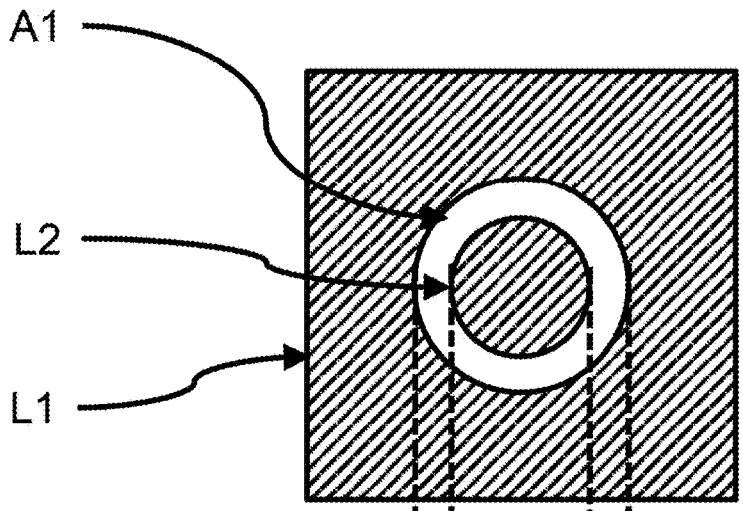
FIG. 6 shows a top view of a conductive layer according to yet another embodiment of the invention.
Figure 7:
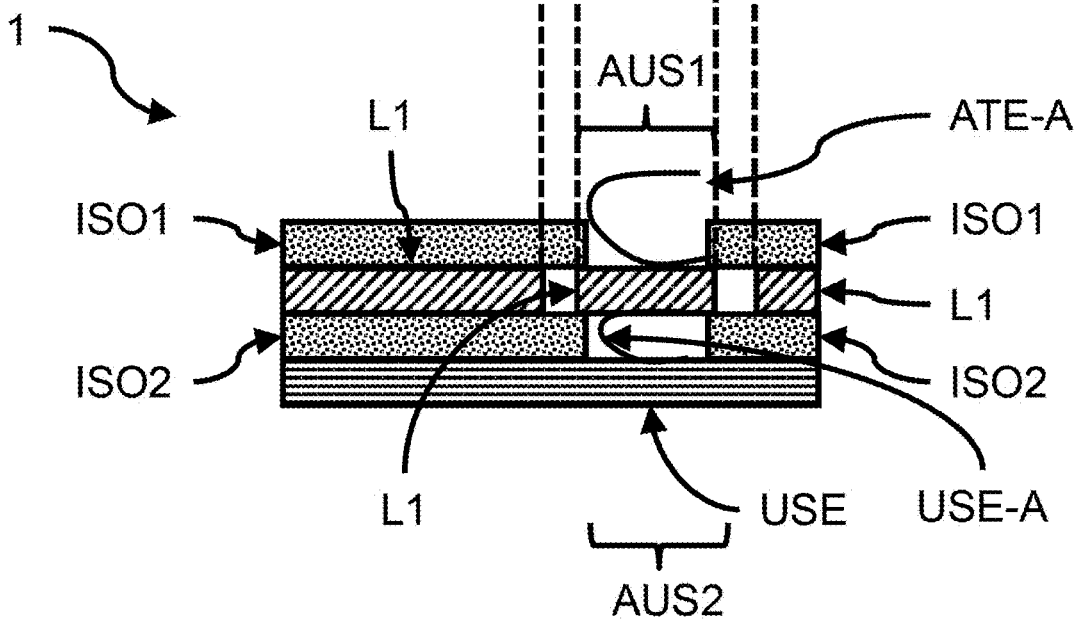
FIG. 7 shows a schematic sectional view of a separating device with a conductive layer according to FIG. 6.
Figure 8:
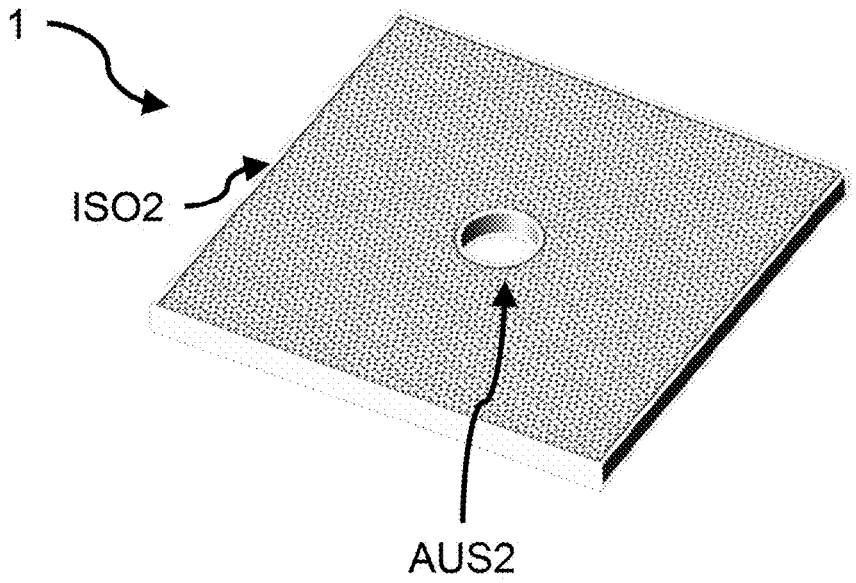
FIG. 8 shows a perspective view of a (lower) insulating layer according to embodiments of the invention.
Figure 9:
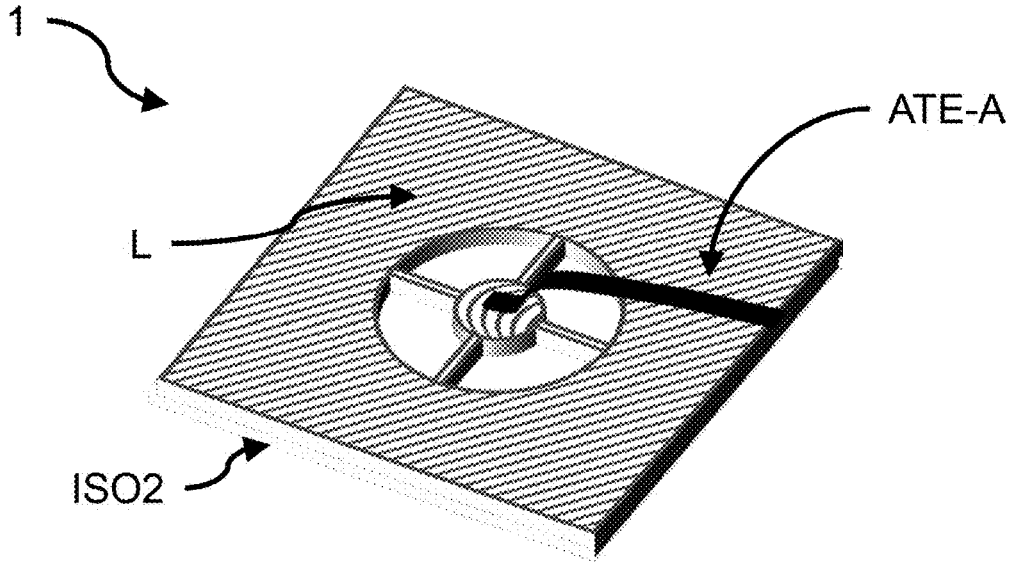
FIG. 9 shows a perspective view according to FIG. 8 also showing a conductive layer according to embodiments of the invention on the (lower) insulating layer.
Figure 10:
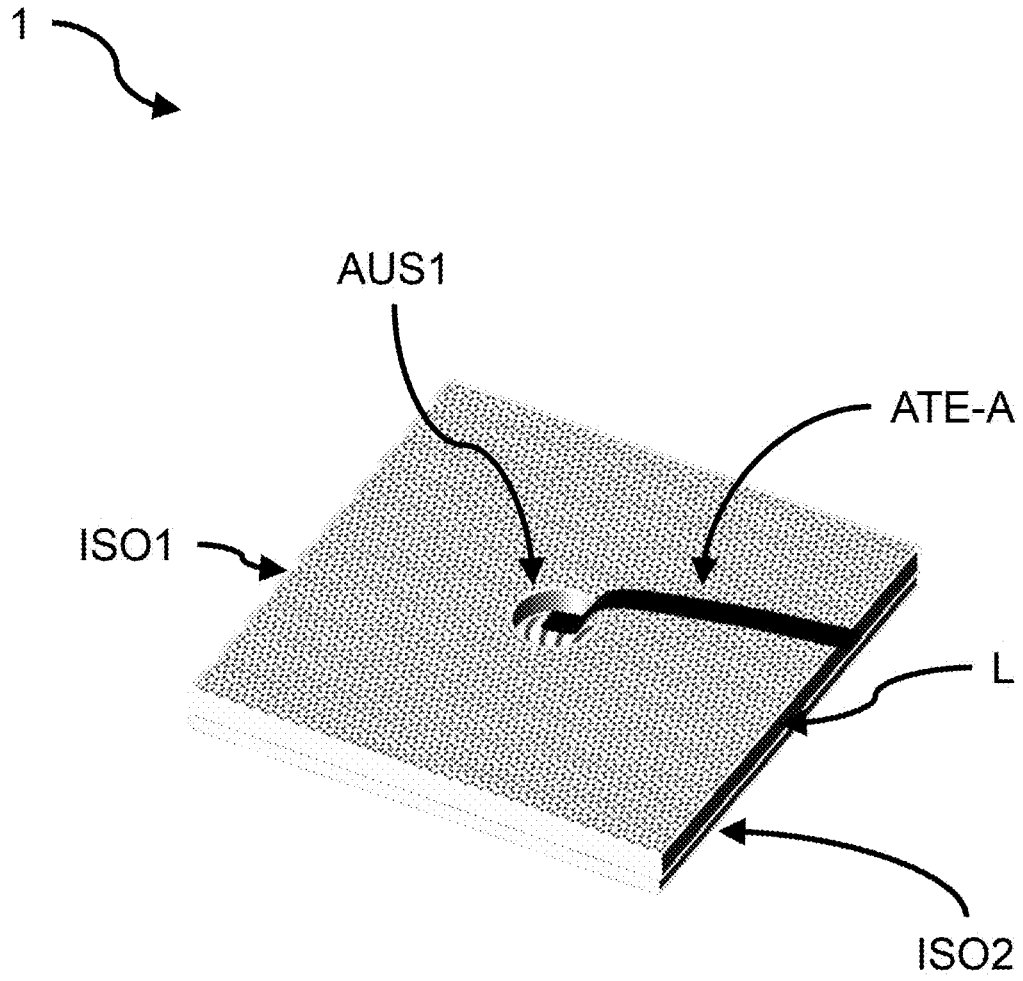
FIG. 10 shows a perspective view according to FIG. 9 also showing an (upper) insulating layer according to embodiments on the conductive layer.

FIGS. 5 and 7 each show a sectional representation of an example of a separating device for an overvoltage protection element USE according to embodiments of the invention. Moreover, a top view of a conductive layer according to the embodiments of FIGS. 5 and 7 is shown in FIGS. 4 and 6.

The separating device 1 is to be arranged between the overvoltage protection element USE and a thermal disconnector ATE. For example, a thermal disconnector can be embodied such that the interruption of an electrical connection, such as a contact ATE-A, is activated by a thermal effect (or other influences). For instance, a point of disconnection can be easily made available by providing the contact ATE-A by means of solder on the separating device 1, with a mechanical prestress being applied to the contact ATE-A which is such that it is moved away from the separating device 1 upon softening of the solder, thereby making an interruption available.

Figure 1:
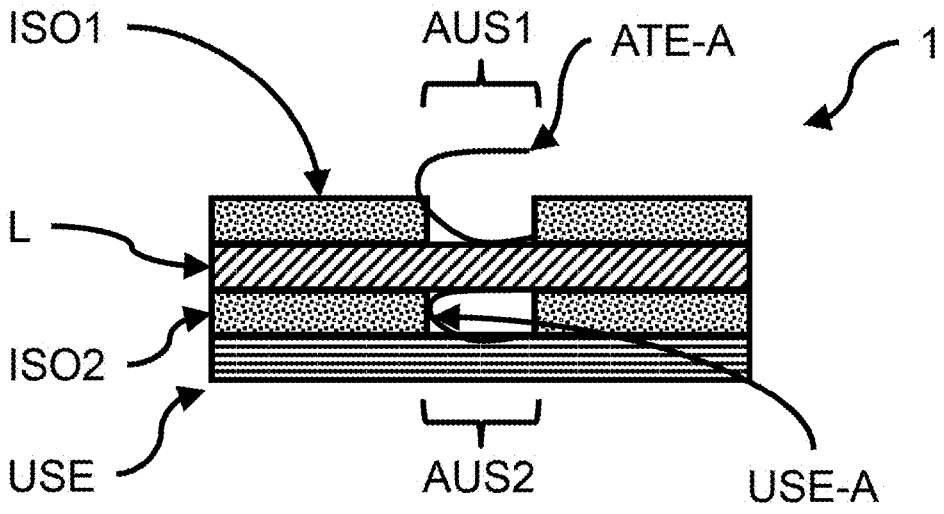
FIG. 1 shows a sectional view of one aspect according to embodiments of the invention.
Figure 2:
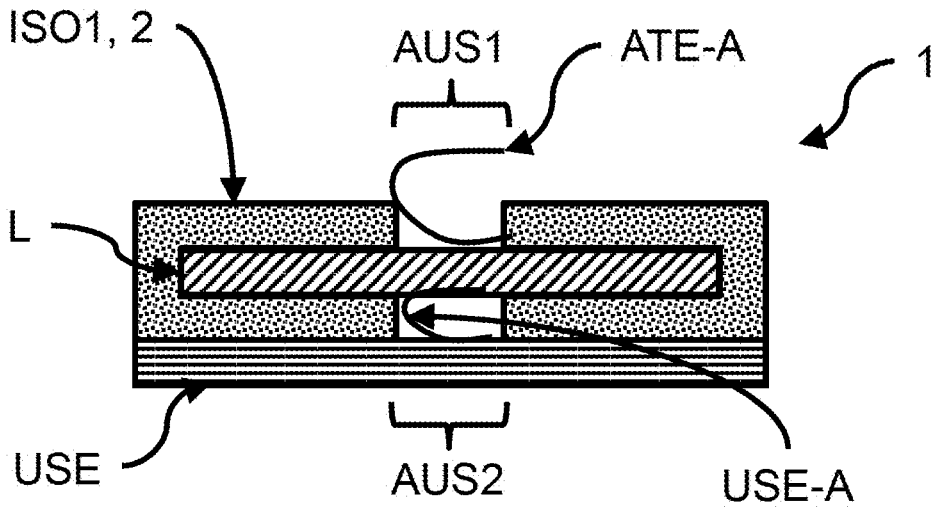
FIG. 2 shows an additional sectional view of one aspect according to embodiments of the invention.
Figures 3A, 3B:
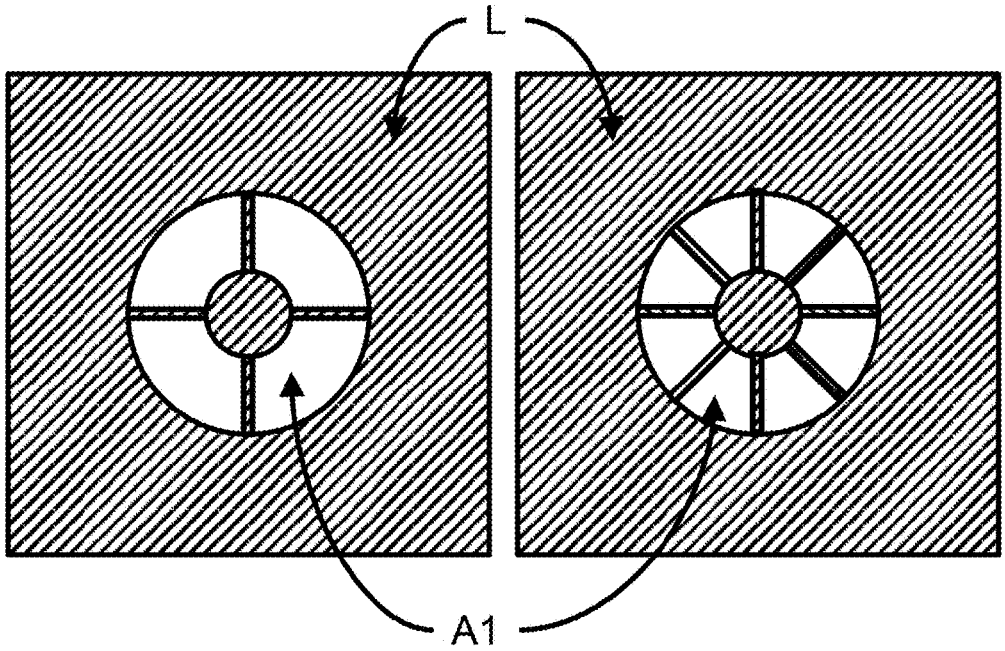
FIGS. 3*a*-3*d* show views of conductive layers according to embodiments of the invention.
Figures 3C, 3D:
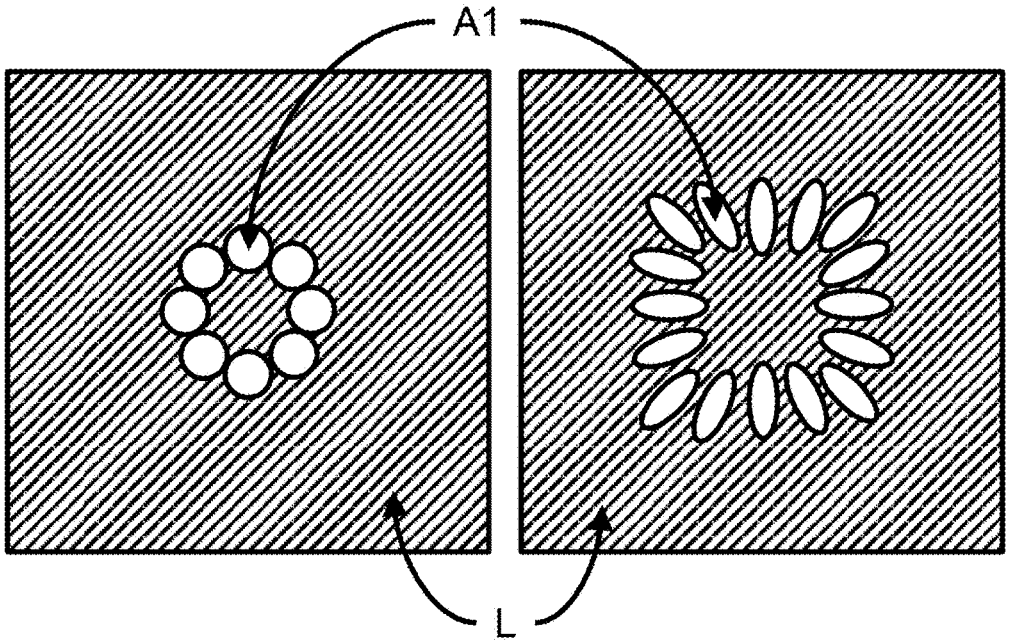

The separating device 1 has a first insulating layer ISO1 and a second insulating layer ISO2. This is exemplified in FIGS. 1 and 2 by a cut-out of a separating device 1. The insulating layer can also be of the wraparound type, as is shown in FIG. 2. The designation "first and second layer" thus refers merely to a layer sequence.

A conductive layer L is arranged between the first insulating layer ISO1 and the second insulating layer ISO2. The first insulating layer ISO1 has a first cutout AUS1 for a contact ATE-A with the disconnector ATE. The second insulating layer ISO2 has a second cutout AUS2 for a contact USE-A with the overvoltage protection element USE.

The cutout or cutouts AUS1 of the first insulating layer ISO1 and the cutout or cutouts AUS2 of the second insulating layer ISO2 offer a possibility for contacting the conductive layer L. The conductive layer L provides a thermal bridge between the overvoltage protection element USE and the thermal disconnector ATE, with the insulating layers ISO1, ISO2 making both a thermal and an electrical insulation available, so that heat of the overvoltage protection element USE can be conducted in a focused manner to the thermal disconnector ATE.

That is, the invention thus not only introduces a logical separation between separating device 1 and overvoltage protection device USE, but also makes a functional (physical) plane of separation available between an overvoltage protection device USE and the separating device 1.

The plane of separation that separates the overvoltage protection device USE and the separating device 1 preferably has a sandwich structure.

There is at least one inner conductive layer L that is composed of an electrically conductive and mechanically stable material (metal, conductive plastic, conductive ceramic) that is enclosed at least in portions by insulating material ISO1, ISO2, preferably a thermally stable plastic, which can also be fiber-reinforced. The inner layer is exposed at least in portions on both sides (AUS1, AUS2), but the sides are not necessarily oppositely situated.

As an exemplary embodiment of a conductive layer L as shown in the schematic cutout of FIG. 2, the sandwich structure can be a (punched) metal part around which plastic ISO1, ISO2 is injected.

The sandwich structure that is exposed at least in portions can be preferably contacted on one side with the overvoltage protection device USE, preferably in a frictional and/or form-fitting manner, by means of contact USE-A.

The thermally linked disconnector, which is preferably linked using a solder, is located on the other side of the electrically conductive layer L that is exposed at least in portions.

The exposed portions for the contacts can be situated directly opposite one another (see FIG. 7), or they can also be offset with respect to one another (see FIG. 5).

In order to conduct the heat quickly from the overvoltage protection device USE into the thermal disconnector, heat sinks can be disposed in the electrically conductive layer L.

For example, the heat sinks—as shown in FIGS. 3*a*-3*d* and FIG. 9—can be provided in the form of differently shaped cutouts A1 from the electrically conductive layer L. The portions of the electrically conductive layer L that are shown to have been left in the middle substantially constitute the contact elements later on. Preferably, a plurality of cutouts A1 are provided (which is advantageous from a production engineering perspective), with the cutouts A1 being substantially similar. A desired physical form can be given to the contact points here by means of simple punching, cutting, or drilling tools, for example.

In order to provide a functional decoupling, the insulating layer ISO1, ISO2—as shown in FIGS. 5 and 7—is embodied such that the respective cutouts AUS1, AUS2 are slightly smaller than the area that is available for contacting, so that a seal/separation can be provided.

In FIGS. 6 to 10, the cutout AUS1 in the first insulating layer is substantially congruent to the cutout AUS2 in the second insulating layer.

This is not a necessary condition, however. Another possibility is shown in FIGS. 4 and 5. Here, the cutout AUS1 in the first insulating layer and the cutout AUS2 in the second insulating layer are not congruent. Nevertheless, the electrical contact is made available via the conductive layer L.

Instead of cutouts A1, the electrically conductive layer L can, in an equivalent manner, also be subdivided into a plurality of parts, L1 and L2, as is shown in FIGS. 6 and 7.

Alternatively or in addition, a thermally anisotropic material such as graphite or carbon nanotubes (CNT), for example, can be used to transfer the heat to the soldering point.

This construction of the inner wall now has no opening and thus encapsulates the overvoltage protection device USE, thereby separating it from the thermal disconnector 1. A plasma or arc that occurs can therefore no longer reach the side of the thermal disconnector 1. The electrical connection is conducted through the inner wall as before.

The mechanical strength of the at least one inner layer L that is made of an electrically conductive and mechanically stable material of the plane of separation protects the thermal disconnector 1 from destruction by the overvoltage protection device USE. The plasma produced as a result and the sharply increased pressure are caught via the plane of separation, so that the thermal disconnector 1 can work unaffected.

In one embodiment of the invention, the conductive layer L is selected from a group that includes metal, metal alloys, particularly (with) copper), conductive plastic, conductive ceramic, with the conductive layer having a layer thickness of 0.3 mm, 1 mm, or more.

In another embodiment of the invention, the first insulating layer ISO1 and/or the second insulating layer ISO2 has a fiber-reinforced material, such as a platinum material of FR4 or better (thermally more stable).

Fuse elements can also be readily introduced into the electrically conductive layer L through appropriate structuring—in FIGS. 4 and 5, for example, between the cutouts AUS1 and AUS2. Alternatively or in addition, this can also be achieved by means of feedthroughs between different conductor path planes (not shown).

Moreover, the invention also proposes a housing having a separating device 1 and an overvoltage protection element USE connected thereto, with the housing enclosing the overvoltage protection element USE in a pressure-tight manner, and with the separating device 1 providing an electrical contact of the overvoltage protection element USE to the thermal disconnector ATE.

The overvoltage protection element USE is preferably a varistor. However, other overvoltage protection devices, such as TVS diodes, for example, are also possible.

LIST OF REFERENCE SYMBOLS

1 separating device
ISO1, ISO2 insulating layer

L, L1, L2 electrically conductive layer
AUS1, AUS2 cutout from insulating layer
A1 cutout(s) from electrically conductive layer
ATE-A contact, thermal disconnector
USE overvoltage protection element
USE-A contact to the overvoltage protection element

What is claimed:

1. A separating device for an overvoltage protection element, wherein the separating device is to be arranged between the overvoltage protection element and a thermal disconnector, wherein the separating device has a first insulating layer and a second insulating layer, wherein a conductive layer is arranged between the first insulating layer and the second insulating layer, wherein the first insulating layer has a first cutout for contacting the disconnector, and wherein the second insulating layer has a second cutout for contacting with the overvoltage protection element, wherein the cutouts provide a possibility for contacting the conductive layer and the conductive layer provides a thermal bridge between the overvoltage protection element and the thermal disconnector, with the insulating layers making both a thermal and an electrical insulation available, so that heat of the overvoltage protection element can be conducted in a focused manner to the thermal disconnector.

2. The separating device as set forth in claim 1, wherein the conductive layer has a plurality of cutouts, with the cutouts being substantially similar.

3. The separating device as set forth in claim 1, wherein the cutout in the first insulating layer is substantially congruent to the cutout in the second insulating layer.

4. The separating device as set forth in claim 1, wherein the conductive layer is selected from a group that includes metal, conductive plastic, and conductive ceramic, with the conductive layer having a layer thickness of 0.3 mm, 1 mm, or more.

5. The separating device as set forth in claim 1, wherein the first insulating layer and/or the second insulating layer has a fiber-reinforced material.

6. A housing having a separating device as set forth in claim 1 and an overvoltage protection element connected thereto, with the housing enclosing the overvoltage protection element in a pressure-tight manner, and with the separating device providing an electrical contact of the overvoltage protection element to a thermal disconnector.

7. The housing as set forth in claim 6, wherein the overvoltage protection element is a varistor.

8. A separating device for an overvoltage protection element, wherein the separating device is to be arranged between the overvoltage protection element and a thermal disconnector, wherein the separating device has a first insulating layer and a second insulating layer, wherein a conductive layer is arranged between the first insulating layer and the second insulating layer, wherein the first insulating layer has a first cutout for contacting the disconnector, and wherein the second insulating layer has a second cutout for contacting with the overvoltage protection element, wherein the cutouts provide a possibility for contacting the conductive layer and the conductive layer provides a thermal bridge between the overvoltage protection element and the thermal disconnector, with the insulating layers making both a thermal and an electrical insulation available, so that heat of the overvoltage protection element can be conducted in a focused manner to the thermal disconnector, wherein:

the conductive layer has a plurality of cutouts, with the cutouts being substantially similar, the cutout in the first insulating layer is substantially congruent to the cutout in the second insulating layer, the conductive layer is selected from a group that includes metal, conductive plastic, and conductive ceramic, with the conductive layer having a layer thickness of 0.3 mm, 1 mm, or more, and the first insulating layer and/or the second insulating layer has a fiber-reinforced material.

9. A housing having a separating device as set forth in claim 8 and an overvoltage protection element connected thereto, with the housing enclosing the overvoltage protection element in a pressure-tight manner, and with the separating device providing an electrical contact of the overvoltage protection element to a thermal disconnector.

10. The housing as set forth in claim 9, wherein the overvoltage protection element is a varistor.

* * * * *